US012752171B2

(12) United States Patent
Rockey et al.

(10) Patent No.: US 12,752,171 B2
(45) Date of Patent: Oct. 6, 2026

(54) GOLF BALL TRAJECTORY MONITOR

(71) Applicant: OPEN LAUNCH LLC, Lafayette, LA (US)

(72) Inventors: Chad Rockey, Plano, TX (US); Taylor Hargrave, Forney, TX (US); Wade Hargrave, Lafayette, LA (US)

(73) Assignee: Open Launch LLC, Lafayette, LA (US)

( * ) Notice: Subject to any disclaimer, the term of this patent is extended or adjusted under 35 U.S.C. 154(b) by 386 days.

(21) Appl. No.: 18/381,494

(22) Filed: Oct. 18, 2023

(65) Prior Publication Data

US 2024/0123314 A1 Apr. 18, 2024

Related U.S. Application Data

(60) Provisional application No. 63/417,222, filed on Oct. 18, 2022.

(51) Int. Cl.
*A63B 69/36* (2006.01)
*A63B 24/00* (2006.01)

(52) U.S. Cl.
CPC ..... *A63B 69/3623* (2013.01); *A63B 69/3658* (2013.01); *A63B 2024/0028* (2013.01); *A63B 2220/806* (2013.01); *A63B 2225/50* (2013.01)

(58) Field of Classification Search
CPC ..... A63B 69/3623; A63B 69/3658; A63B 2024/0028; A63B 2220/806; A63B 2225/50; A63B 24/0021; A63B 2024/0031; A63B 2024/0034; A63B 2220/30; A63B 2220/35; A63B 2220/89
USPC ..... 473/131, 151, 154, 155, 153, 257
See application file for complete search history.

(56) References Cited

U.S. PATENT DOCUMENTS 8,007,367 B2 * 8/2011 Dilz, Jr. ..... G01S 13/583 473/154
8,085,188 B2 * 12/2011 Tuxen ..... G01S 13/867 473/150
8,982,216 B2 * 3/2015 Ishii ..... H04N 5/262 348/157
9,855,481 B2 * 1/2018 Tuxen ..... G06F 18/22
10,898,757 B1 * 1/2021 Johansson ..... G01S 13/587
(Continued)

FOREIGN PATENT DOCUMENTS

KR 200377371 Y1 3/2005
KR 20150098585 A 8/2015

*Primary Examiner* — Nini F Legesse
(74) *Attorney, Agent, or Firm* — James R. Gourley; Carstens, Allen & Gourley, LLP

(57) ABSTRACT

A system for monitoring a trajectory of a golf ball. The system comprising a first camera configured to capture a first image of the golf ball and a second camera configured to capture a second image. The system further comprises a radar configured to detect flight characteristics of the golf club. The system further comprises a processor configured to trigger the first camera to capture the first image of the golf ball based on flight characteristics of the golf club. The processor is further configured to trigger the second camera to capture the second image of the golf ball after the first camera captures the first image. The processor is further configured to present the trajectory of the golf ball to an interface or display, wherein the trajectory is based on the first image, the second image, and the flight characteristic of the golf club.

24 Claims, 11 Drawing Sheets

(56) References Cited

U.S. PATENT DOCUMENTS

| | | | | |
|---|---|---|---|---|
| 2006/0040756 | A1* | 2/2006 | Kestler | A63B 69/3658 473/131 |
| 2007/0105637 | A1* | 5/2007 | Shimizu | A63B 71/06 473/151 |
| 2017/0072261 | A1* | 3/2017 | Kim | A63B 69/3658 |
| 2017/0136336 | A1* | 5/2017 | Vollbrecht | G01S 13/88 |
| 2018/0051982 | A1* | 2/2018 | Yin | G06T 7/596 |
| 2020/0398138 | A1* | 12/2020 | Hendrix | A63F 13/812 |
| 2021/0252407 | A1* | 8/2021 | Witchey | A63F 13/69 |
| 2021/0275873 | A1* | 9/2021 | Johansson | A63B 24/0021 |

* cited by examiner

GOLF BALL TRAJECTORY MONITOR

CROSS REFERENCE TO RELATED APPLICATION

This application claims the benefit of provisional U.S. Application No. 63/417,222 entitled "Golf Ball Trajectory Monitor" filed Oct. 18, 2022, the technical disclosure of which is incorporated herein by reference in its entirety.

TECHNICAL FIELD

The present disclosure relates golf simulators or golf-related game units that measure a trajectory of a golf ball.

BACKGROUND

Golf simulators provide users with an indoor alternative to practice their golf game. Conventional golf simulators rely on expensive equipment to accurately predict the trajectory of a golf ball and display that trajectory on a screen. The conventional golf simulators are also cumbersome and not portable. Therefore, it is desirable to have a golf simulator or game unit that accurately and inexpensively predicts the trajectory of a golf ball.

Golf simulators also lack functional means for the user to navigate or interact with the simulation or game. Instead, conventional golf simulators rely on buttons and physical general or special purpose controllers for user navigation and interaction, which provides the user with another object to manipulate. Therefore, it is desirable to have a golf simulator that utilizes the user's golf club to navigate or interact with the golf simulation or game.

SUMMARY

In one aspect, the present disclosure is directed to a system for monitoring a trajectory of a golf ball is disclosed. The system comprises a first camera configured to capture a first image of the golf ball after the golf ball is struck by a golf club. The system further comprises a second camera configured to capture a second image of the golf ball after the first image is captured. The system further comprises a radar having a detection field. The radar is configured to detect flight characteristics of the golf club or golf ball within the detection field. The system further comprises a processor in communication with the first camera, the second camera, and the radar. The processor is configured to trigger the first camera to capture the first image of the golf ball based on the radar detecting a flight characteristic of the golf club or golf ball. The processor is further configured to trigger the second camera to capture the second image of the golf ball after the first camera captures the first image. The processor is further configured to present the trajectory of the golf ball to an interface, wherein the trajectory is based on the first image, the second image, and the flight characteristic of the golf club or golf ball.

In another aspect, the present disclosure is directed to a computing device for determining a trajectory of a golf ball. The computing device configured to receive information associated with flight characteristics of the golf club or golf ball, which are used to determine a speed of the golf club or golf ball. The computing device determines a speed of the golf ball after the golf ball is struck by the golf club. The computing device is configured to transmit a first command to a first camera to capture a first image of the golf ball after the golf ball is struck by the golf club. The computing device is also configured to transmit a second command to a second camera to capture a second image of the golf ball. The computing device receives the first image and the second image. The computing device determines the trajectory of the golf ball based on the first image, the second image, the flight characteristics of the golf club or golf ball, and the speed of the golf ball. The computing device presents the trajectory of the golf ball to an interface.

BRIEF DESCRIPTION OF THE DRAWINGS

The foregoing aspects and many of the attendant advantages of the present technology will become more readily appreciated by reference to the following Detailed Description, when taken in conjunction with the accompanying simplified drawings of example embodiments. The drawings, briefly described here below, are presented for ease of explanation and do not limit the scope of the claimed subject matter.

DETAILED DESCRIPTION

Figure 1A:
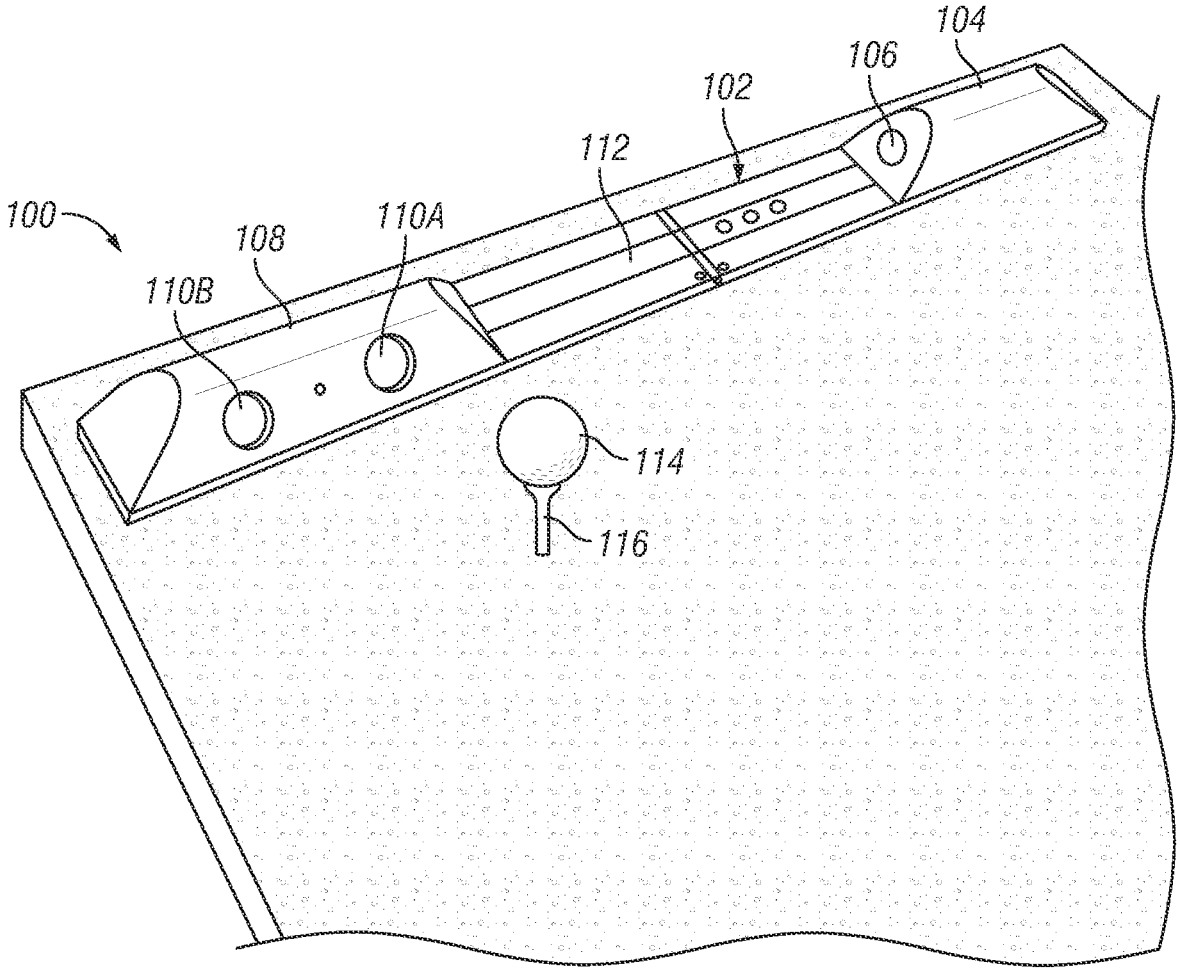
FIG. 1A depicts a perspective view of an embodiment of a system for monitoring a trajectory of a golf ball.
Figure 1B:
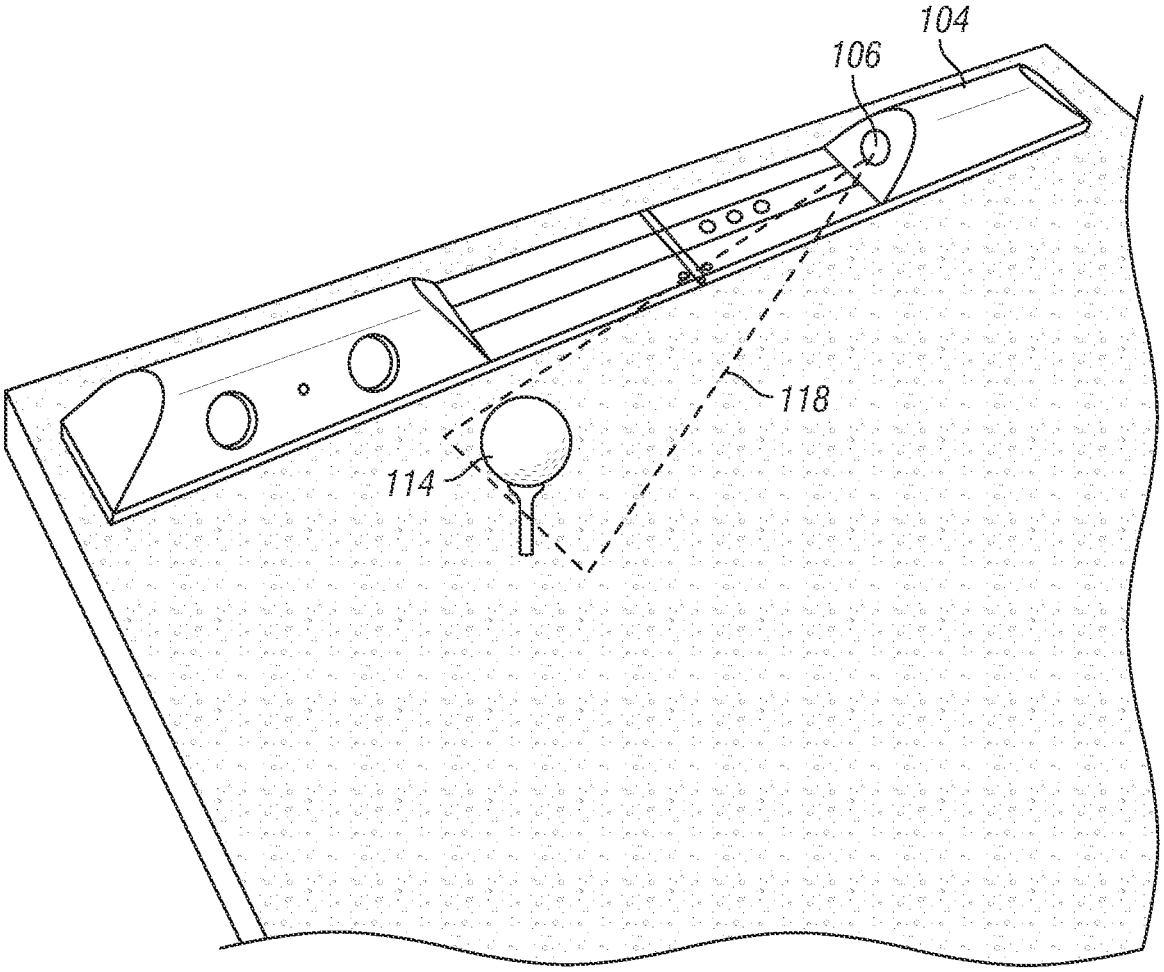
FIG. 1B depicts another perspective view of the embodiment illustrated in FIG. 1A.
Figure 1C:
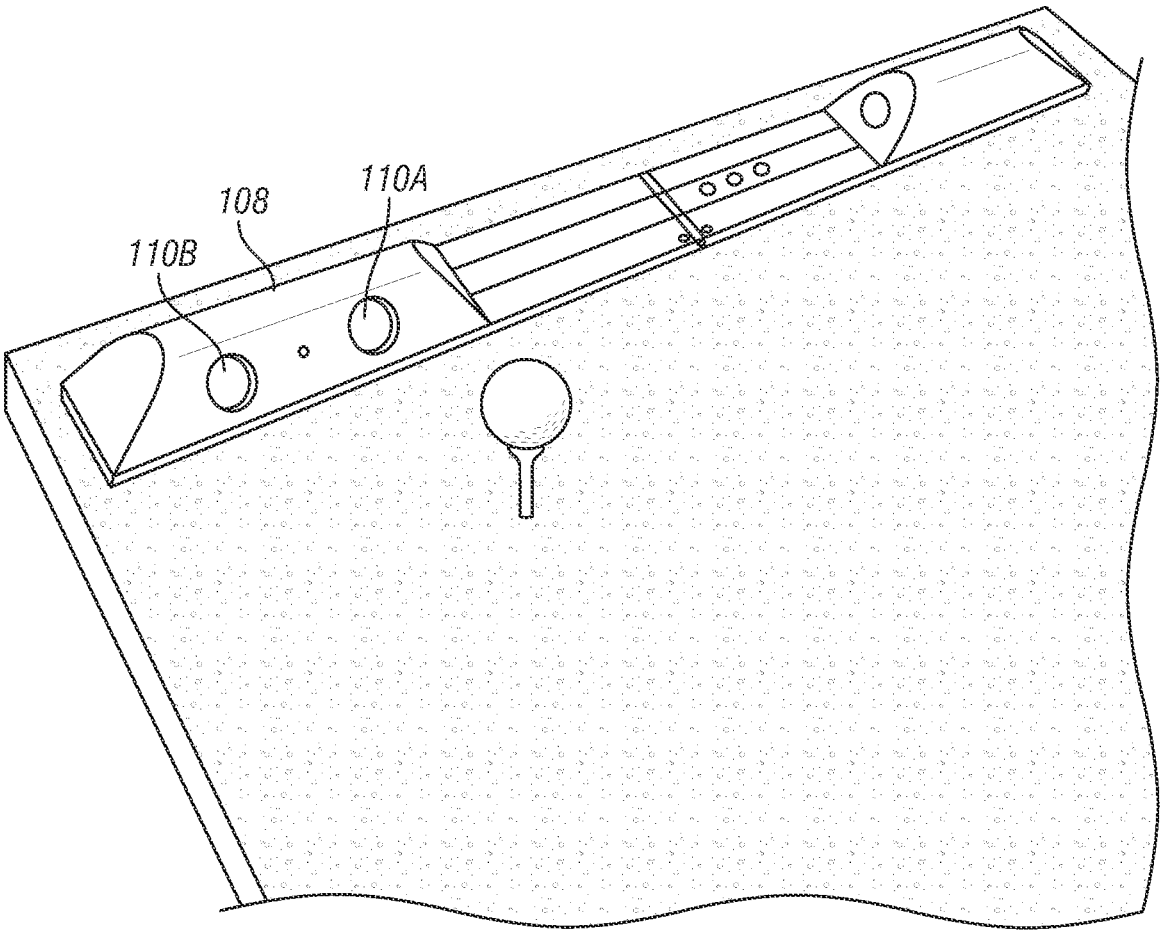
FIG. 1C depicts another perspective view of the embodiment illustrated in FIG. 1A.

FIGS. 1A-1C depict an embodiment of a system 100 for monitoring a trajectory of a golf ball 114. The system 100 comprises a first camera 110A configured to capture a first image of the golf ball 114 after the golf ball 114 is struck by a golf club (not pictured). The system 100 further comprises a second camera 110B configured to capture a second image of the golf ball 114 after the first image is captured. In one embodiment, the first camera 110A and second camera 110B (collectively 110) use identical lenses, providing the same field of view for capturing images of the golf ball 114. In other embodiments, the cameras 110 use different lenses, providing different fields of view for capturing images of the golf ball 114.

The system 100 further comprises a radar 104 having a detection field 118. The radar 104 is configured to detect flight characteristics of the golf club or golf ball, or both, within the detection field 118. The radar 104 comprises a transmitter (not pictured), a switch (not pictured), and a radar antenna behind lens 106. The transmitter generates the pulse that is transmitted by the antenna 106 into the environment. The switch controls the transmission of the antenna at 106. The radar 104 can be configured to transmit pulses within a predefined detection field 118. It is advantageous to define the boundaries of the detection field 118 because it avoids detecting extraneous objects that would inhibit detection of the golf club and/or golf ball 114.

The system 100 further comprises a processor 108 in communication with the first camera 110A, the second camera 110B, and the radar 104. The processor 108 is configured to trigger the first camera 110A to capture the first image of the golf ball 114 based on the radar 104 detecting a flight characteristic of the golf club, golf ball, or both. The processor 108 is further configured to trigger the second camera 110B to capture the second image of the golf ball 114 after the first camera 110A captures the first image. The second camera is triggered based on the golf ball speed or trajectory measured by the radar, the golf ball image characteristics captured by the first camera, or both. The processor 108 is further configured to present the trajectory of the golf ball 114 to an interface or display (not pictured). The trajectory is based on the first image, the second image, and the flight characteristics of the golf club or golf ball detected by the radar.

The system 100 may further comprise a control bar 112 for controlling actions on the interface or display. In some embodiments, the radar 104, the processor 108, the cameras 110, and the control bar 112 may be configured as a singular device 102. In such embodiments, the cameras 110 and the processor 108 may be located in the same housing. Configuring the components (104, 108, 110, 112) into a singular device 102 is beneficial because it increases the portability of the system 100. The singular device may, in one embodiment, be foldable at a hinge provided between the radar housing and the camera housing to provide for more compact storage and transportation.

With continued reference to FIGS. 1A-1C, the device 102 is configured with the radar 104 positioned at the rear of the device 102, the processor 108 and cameras 110 positioned at the front of the device 102, and the control bar 112 interconnecting the radar 104 and the processor 108 and cameras 110. The golf ball 114 is preferably initially placed within view of at least the first camera 110A. A tee 116 may be used to support the golf ball 114 for use in the system 100.

Figure 2A:
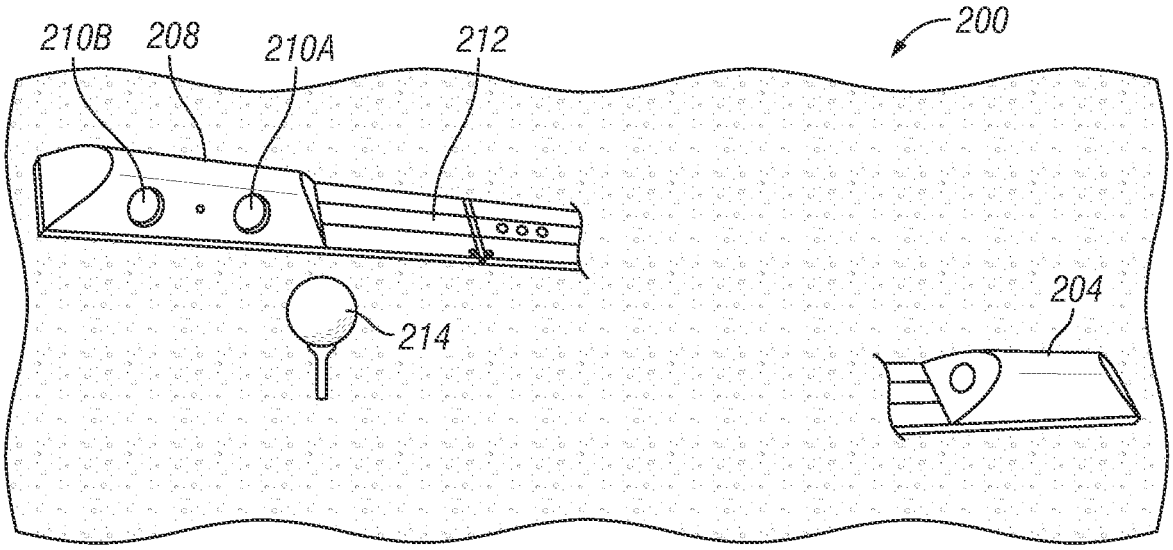
FIG. 2A depicts a perspective view of another embodiment a system for monitoring a trajectory of a golf ball.
Figure 2B:
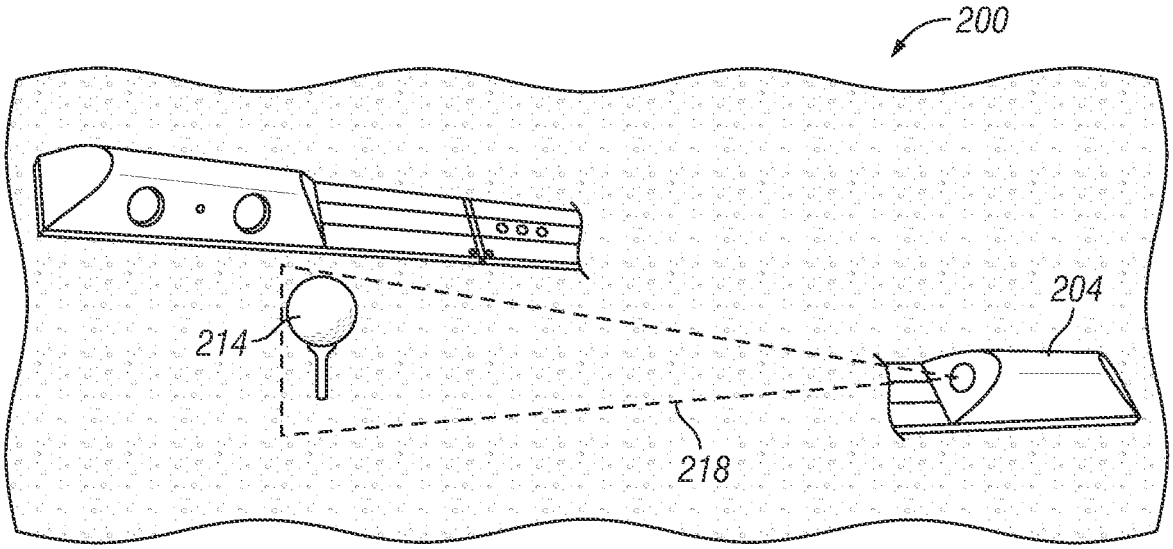
FIG. 2B depicts another perspective view of the embodiment illustrated in FIG. 2A.
Figure 2C:
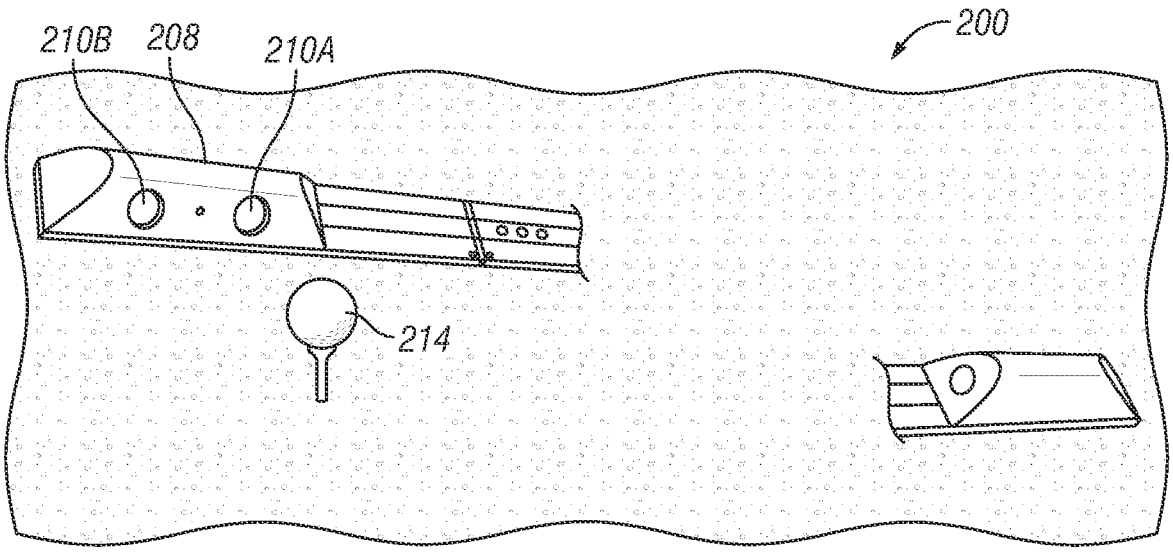
FIG. 2C depicts another perspective view of the embodiment illustrated in FIG. 2A.

Turning to FIGS. 2A-2C, an alternate embodiment of a system 200 for monitoring a trajectory of a golf ball 214 is shown. The system includes the radar 204, the processor 208, the first camera 210A and the second camera 210B (collectively 210), and the control bar 212. The system 200 is configured with the radar 204 in a housing that is separate from and not physically connected to the processor 208, cameras 210, and control bar 212. In at least one embodiment, the radar is positioned directly behind the golf ball 214. The radar 204 can be configured to transmit pulses within a predefined detection field 218. In addition to the benefits of defining the detection field 218 explained above, it may also be beneficial to position the radar 208 directly behind the golf ball 214 because it decreases the likelihood that any extraneous objects will be detected and eliminates a source of error known as the cosine effect where the radar only measures the component of the velocity perpendicular to its center field of view. Instead, positioning the radar 208 directly behind the golf ball 214 increases the likelihood that only the golf club and/or golf ball 214 will be detected.

Figure 3:
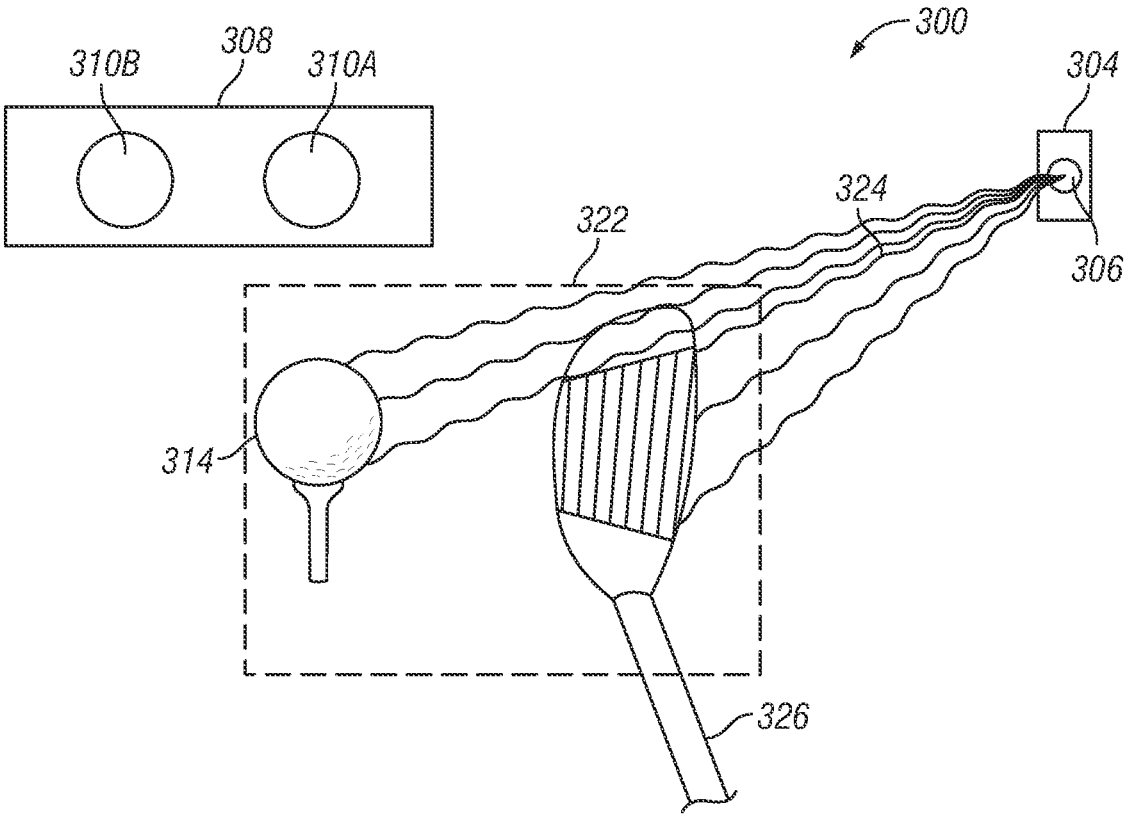
FIG. 3 depicts a diagram of an embodiment a system for monitoring a trajectory of a golf ball.

With reference to FIG. 3, an embodiment a system 300 for monitoring a trajectory of a golf ball 314 is shown. The system 300 comprises a radar 304 for detecting movement of a golf club 326 within a detection field 322. The antenna 306 of the radar 304 transmits pulses 324 to the detection field 322. Once the golf club enters the detection field, the pulses 324 are reflected off the golf club or golf ball, or both, back to the antenna 306. The radar 304 detects the movement and/or speed of the golf club 326 as the user swings the golf club 326 through the detection field 322, and/or the radar 304 detects the movement and/or speed of the golf ball 314 after the golf club 326 strikes the golf ball 314. The first camera 310A captures a first image of the golf ball 314 after the golf club 326 strikes the golf ball 314. Alternatively, the first camera 310A may capture the first image of the golf ball when the golf club 326 strikes the golf ball 314 or prior to the golf club 326 striking the golf ball 314. After a period of time, the second camera 310B captures a second image of the golf ball 314.

Figure 4:
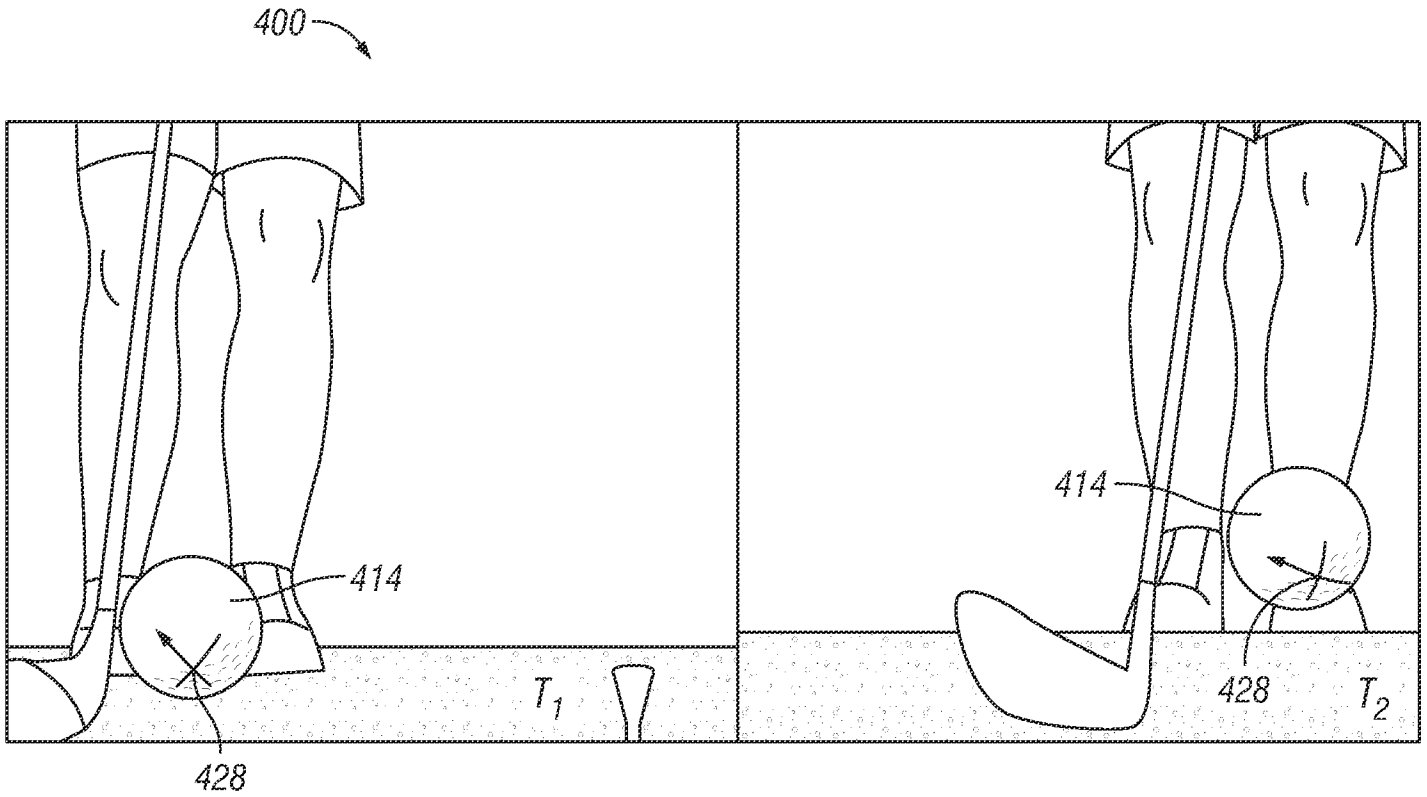
FIG. 4 depicts an interface of images of a golf ball in flight.

Turning to FIG. 4, a composite 400 of two images of a golf ball 414 in flight is shown. The first image shown is captured at time T1 after the golf club strikes the golf ball. The second image shown is captured at time T2 after the first image is captured. The golf ball 414 in both images is shown having a reference arrow 428. The reference arrow 428 is provided for illustrative purposes to show the rotation (i.e., backspin) of the golf ball between the first image at T1 and the second image at T2. Additionally, the first image at T1 illustrates the golf ball 314 having a first position (x1, y1) and the second image at T2 illustrates the golf ball 314 having a second position (x2, y2). Accordingly, the ball has traveled a horizontal distance ($\Delta x$) and a vertical distance ($\Delta y$), which can be used to determine the launch angle of the golf ball 314. Further, the speed of the golf ball 414 may be calculated based on the distance traveled by the golf ball 314 and the time between the first image at T1 and the second image at T2. Still further, the lateral movement of the golf ball 414 may be determined based on the area of the golf ball 414 and/or the pixel change in the golf ball 414. The area becoming larger (or more pixels in the golf ball) in the second image is indicative of the golf ball traveling in a negative z-direction (toward the cameras). The area becoming smaller (or fewer pixels in the golf ball) in the second image is indicative of the golf ball traveling in a positive z-direction (away from the cameras). No change in the area or pixels is indicative that the golf ball is not traveling in a z-direction (i.e., straight path relative to the cameras). The lateral movement is the movement of the golf ball along the z-axis, with the horizontal movement along the x-axis and the vertical movement along the y-axis. It has been found that one approach to determining ball flight trajectory is to use a projected spherical fit to an ellipse based on a sphere to image plane calculation. This then can be used to determine the origin of a sphere with that major axis and known radius. It is based on a more advanced description of the number of pixels, as the length and location of the major axis is measured in pixels and can be used calculate the other parameters.

Figure 5A:
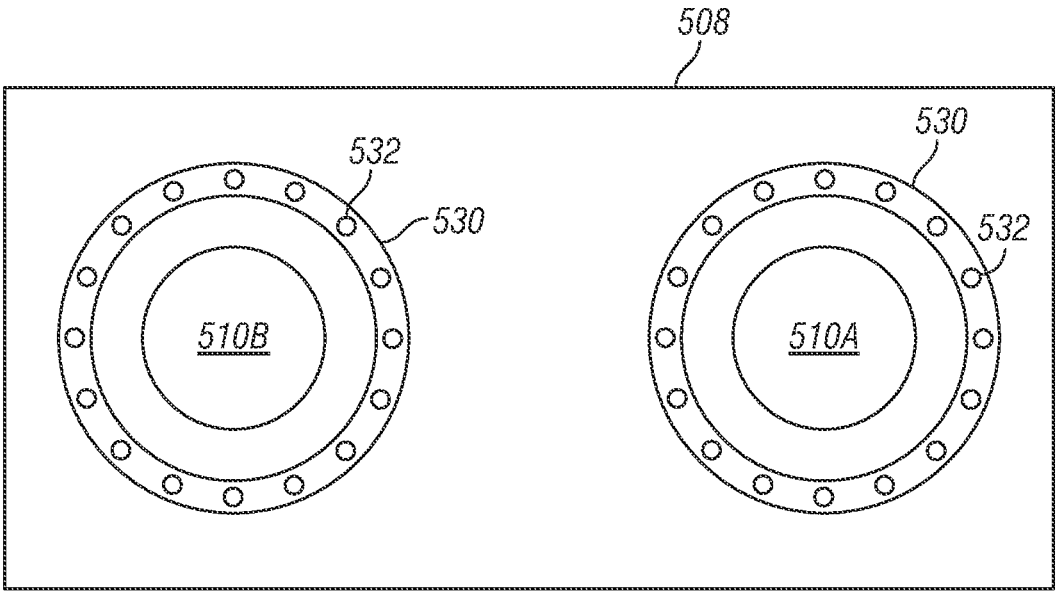
FIG. 5A depicts an embodiment of a camera used in the system for monitoring a trajectory of a golf ball.
Figure 5B:
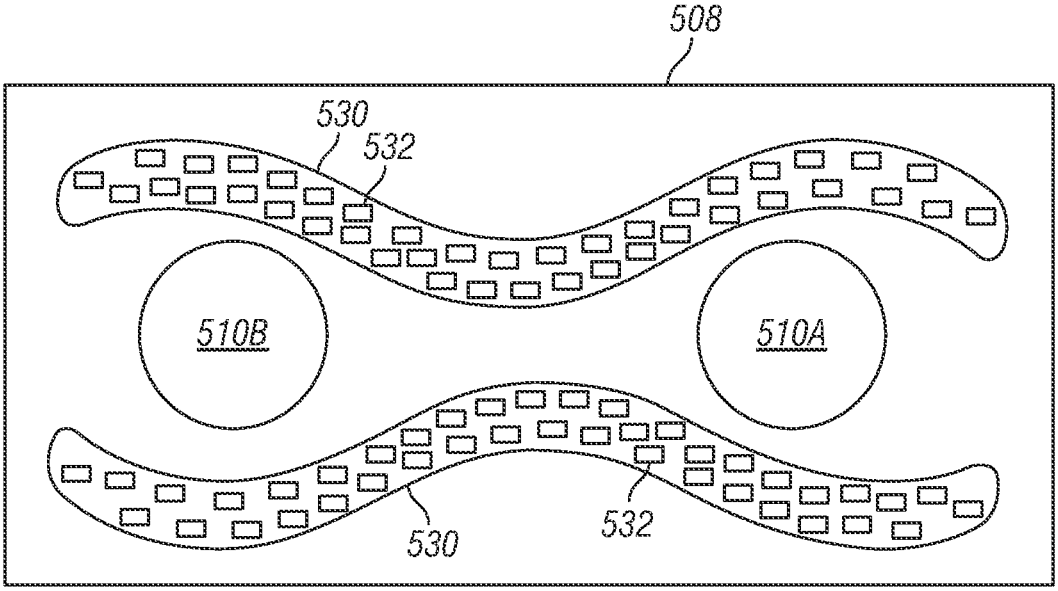
FIG. 5B depicts another embodiment of a camera used in the system for monitoring a trajectory of a golf ball.

With reference to FIGS. 5A-5B, embodiments of a housing 508 used in the system for monitoring a trajectory of a golf ball are illustrated. In FIGS. 5A-5B, the housing 508 comprises a first camera 510A and a second camera 510B (collectively 510). In FIG. 5A, the housing 508 is configured with circular flash strips 530 circumscribing the lenses for cameras 510. In FIG. 5B, the housing 508 is configured with two bar flash strips 530 positioned above and below the cameras 510. The flash strips 530 comprise multiple individual lights 532 positioned along the flash strips 530. In some configurations, the circular flash strips 530 utilize infrared lights 532, whereby the flash is imperceptible to the human eye. It is advantageous to utilize such imperceptible light because a visible flash may distract the user during the swing. It may be preferable to utilize the circular flash strip 530 configuration illustrated in FIG. 5A because it provides a balanced exposure, resulting in clear views of the dimples of golf ball. As exposures become more unbalanced, the amount of shadows on the golf ball increases and distorts the shape of the dimples on the golf ball, leading to errors in calculations.

Figure 6:
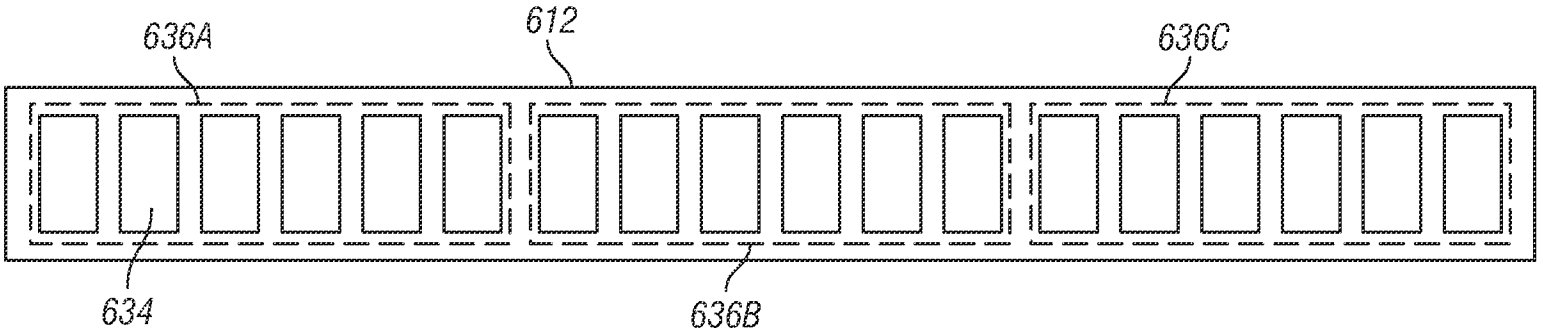
FIG. 6 depicts an embodiment of a control bar used in a system for controlling a golf simulation.

Turning to FIG. 6, an embodiment of a control bar 612 used in a system for controlling a golf simulation or golf game is illustrated. The control bar 612 may include a plurality of lights 634 (e.g., LED lights) on a strip that light up to indicate the position of the club head.

The plurality of lights 634 on the strip may be divided into sections 636. For example, in FIG. 6, the control bar 612 is divided into a first section 636A, a second section 636B, and a third section 636C. Each section can be programmed as analogous to a button on a game controller, and each virtual button can be actuated by, for example, positioning the club head over the button for a predetermined period of time. Also, for example, each virtual button can be made visually identifiable and distinguishable from other virtual buttons by changing the color of the lights that comprise each section or button. For example, one virtual button can be highlighted in blue lights, while another virtual button can be highlighted in green lights. Actuating the virtual buttons can be used to control different aspects of the golf simulator or golf video game. The virtual buttons that are actuated by the golf club head using the control bar can also be shown on the display associated with the golf simulator or golf video game.

The position of the club head over the control bar 612 is determined using one or more proximity sensors above the strip of lights, for example, one or more infrared proximity sensors. In one embodiment, the control bar 612 is used with two infrared-based proximity sensors (not pictured). For example, one proximity sensor can be positioned on each end of the light strip, and the detected position of each sensor can be interpolated to provide an accurate composite position.

In one embodiment, when the golf club (specifically, the head of a golf club) is positioned over the control bar 612, the lights 634 corresponding to the position of the golf club can be configured to light up. In this embodiment, as the golf club is moved along the length of the control bar 612, the corresponding lights 634 below the club's current position can illuminate to demonstrate the position of the golf club, while the lights 634 that are not below the club's current position are not illuminated. The length of the control bar 612 may be between about 0.3 meters and about 3.0 meters.

The control bar can facilitate various types of inputs into a golf simulator or golf video game. Providing virtual buttons using the control bar has already been described above. Other types of inputs include swipe gestures, where moving the club head one direction or the other over the control bar can provide different inputs into the golf simulator or video game. For example, if the golf simulator or video game includes the option to change the aim or shot direction of the next shot, moving the club head to the left or right over the control bar can move the shot direction on the simulator or game left or right accordingly. Swipe gestures can also be used to change other options in the simulation or game, such as the selection of different menu options, selection of which golf club to use, or manipulate the slice or hook spin imparted to the golf ball when it is struck. The control bar can also be manipulated using different types of objects, such as the foot or hand of the user, or the end of a stick.

Figure 7:
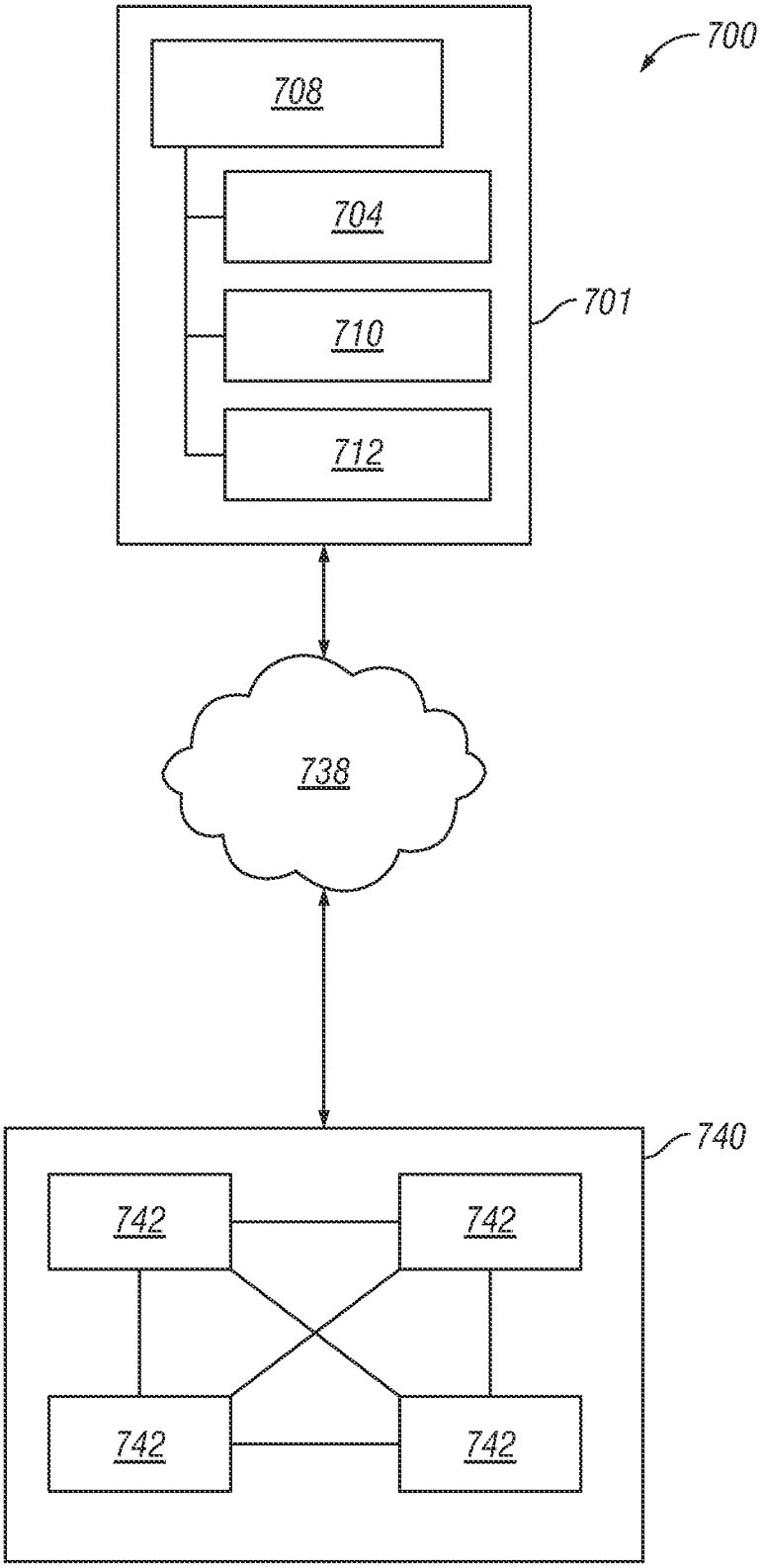
FIG. 7 depicts an embodiment of an environment in which systems and/or methods, described herein, may be implemented.

With reference to FIG. 7, an embodiment of an environment 700 in which systems and/or methods, described herein, may be implemented is illustrated. The environment 700 comprises a golf simulator or game device 701. The environment 700 further comprises a platform 740, where the platform 740 and the processor 708 are in communication via the network 738. The devices of environment 700 may interconnect via wired connections, wireless connections, or a combination of wired and wireless connections.

The simulator or game device 701 includes a radar 704, cameras 710, a control bar 712, and a processor 708. The processor 708 is communicatively coupled with the radar 704, the cameras 710, and the control bar 712. As explained herein the radar 704 is configured to detect motion properties of the golf club and/or the golf ball. The cameras 710 are configured to capture images of the golf ball in flight. The control bar 712 is configured to enable control of or provide inputs into the simulation or game. The processor 708 is configured to control the radar 704, the cameras 710, and the control bar 712. The processor 708 is capable of receiving, generating, storing, processing, and/or providing information associated with the golf simulation or golf game. For example, the processor 708 may include a computing device, a server, a group of servers, a user device (e.g., a laptop computer, a desktop computer, etc.), and/or the like.

The platform 740 includes one or more computing resources 742 capable of receiving, generating, storing, processing, and/or providing information associated with the golf simulation or game. For example, the platform 740 may include a server, a group of servers, and/or the like. In some embodiments, the platform 740 may be partially or entirely implemented in a cloud computing environment.

A cloud computing environment includes an environment that delivers computing as a service, whereby shared resources, services, etc. may be provided to the processor 708 and/or platform 740. A cloud computing environment may provide computation, software, data access, storage, and/or other services that do not require end-user knowledge of a physical location and configuration of a system and/or a device that delivers the services.

The number and arrangement of devices and networks shown in FIG. 7 are provided as an example. In practice, there may be additional devices and/or networks, fewer devices and/or networks, different devices and/or networks, or differently arranged devices and/or networks than those shown in FIG. 7. Furthermore, two or more devices shown in FIG. 7 may be implemented within a single device, or a single device shown in FIG. 7 may be implemented as multiple, distributed devices. Additionally, or alternatively, a set of devices (e.g., one or more devices) of environment 700 may perform one or more functions described as being performed by another set of devices of environment 700.

In a preferred embodiment, the game device 701 communicates data gathered from the radar 704, cameras 710, control bar 712, or processor 708 directly to platform 740 via network 738, forming a chain of trust between the game device 701 and the platform 740. The chain of trust is established from the game device 701 to ensure that the game device 701 has not been tampered with by the end user, and to ensure that the data received by the platform 740 accurately reflects the data gathered from the tamper-free game device 701. In one embodiment, the network 738 is the internet, and the platform 740 is in the cloud.

The data communicated from the game device 701 to the platform 740 is then used to generate golf game or golf simulation data, which is then transmitted to one or more user devices, which display the game or simulation data or result of such data. In this arrangement, users in different locations can play the same game or simulation and trust that the results of the game or simulation are not the result of tampering with the game device or otherwise based on inaccurate or fabricated data. In one embodiment, the raw data gathered from the cameras or radar is transmitted via the network 738 to the platform 740 for further processing to determine ball flight characteristics, such as speed or launch angle. In another embodiment, at least some of the raw data processing occurs at the processor 708 of the game device 701 before being sent via network 738 to platform 740. In every aspect of this embodiment, data from the game device 701 is transmitted via network 738 to platform 740 before any involvement by a user device (i.e. before any data is transferred to a user device that is outside the chain of trust between the game device 701 and the platform 740. Again, this ensures the trustworthiness of the data and the accuracy of the game or simulation results.

In another embodiment, the platform 740 is running on the end user's own electronic device, which is connected to the game device 701 via a network 738. In this embodiment, the user's device is made a part of the chain of trust and processes the data to generate the golf game or golf simulation data. The user's device in this embodiment would be running an executable program with a digital certificate that ensures no data has been manipulated to be inconsistent with the raw data or accurately processed data. The game device can be configured to transmit the raw data to a separate verification platform running in the cloud, which can analyze the raw data to determine whether the user's device has accurately processed the raw data and generated trustworthy golf game or golf simulation data. This separate verification can occur simultaneously with the processing on the user's device or can occur later in time to verify game or simulation results that have already been displayed on a user's device.

Figure 8:
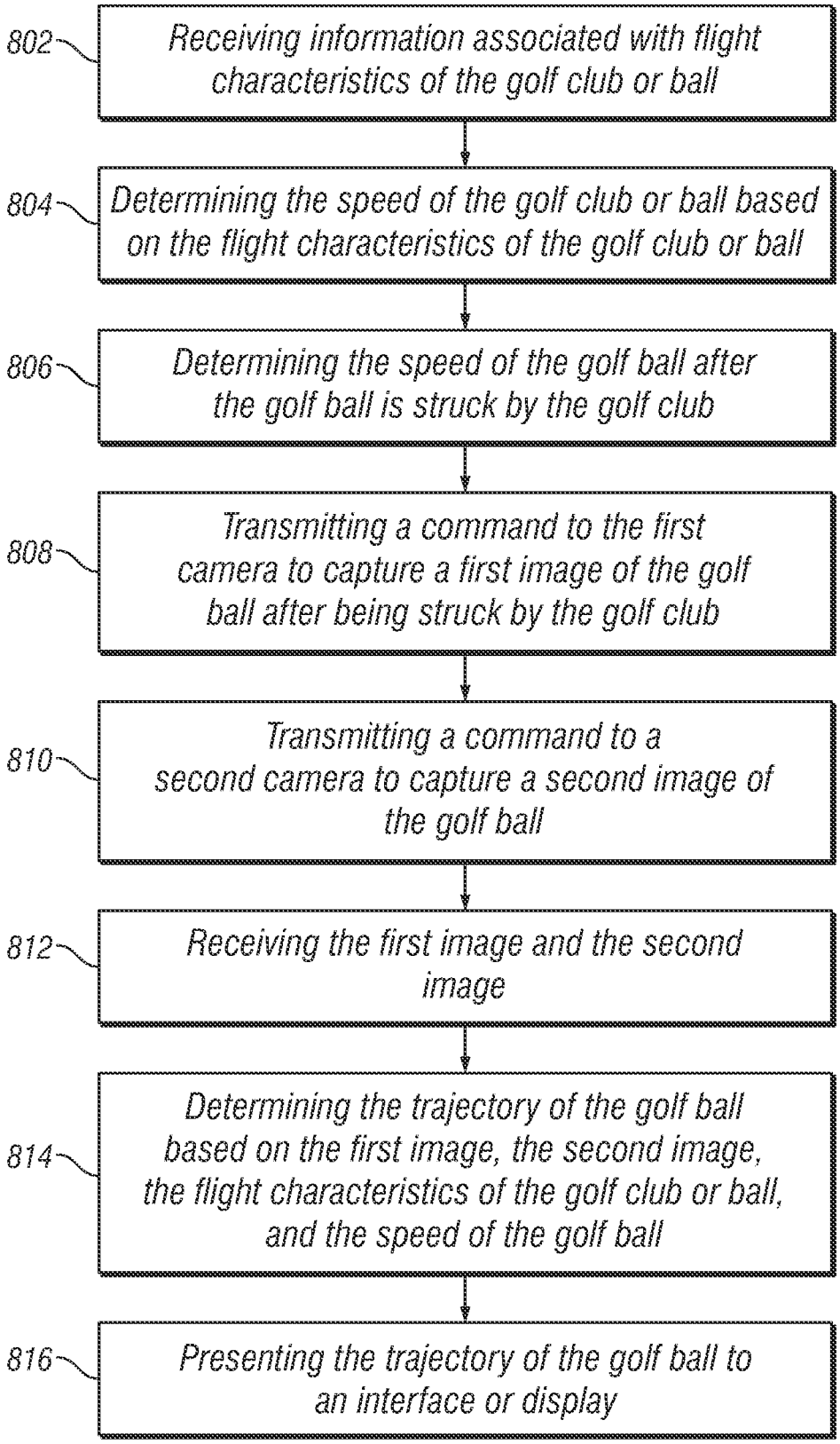
FIG. 8 is a flow chart depicting a process for monitoring and/or determining the trajectory of a golf ball.

Turning to FIG. 8, a flow chart depicting a process 800 for monitoring and/or determining the trajectory of a golf ball is shown. In some embodiments, one or more process blocks may be performed by the platform 740. In some embodiments, one or more process blocks may be performed by another device or group of devices separate from or including the platform 740, such as the processor 708.

The process 800 includes receiving 802 information associated with flight characteristics of the golf club, golf ball, or both. The flight characteristics of the golf club or golf ball may include radar readings of the golf club or golf ball at one or more positions in a detection field. The process includes determining 804 the speed of the golf club or golf ball based on the flight characteristics of the golf club. In at least one embodiment, the speed of the golf club or golf ball is determined by applying a fast Fourier Transform to the radar readings to convert the radar readings into a speed of the golf club or golf ball. The speed of the golf club or golf ball may be determined at time and/or position when the golf club strikes the golf ball. The process continues with determining 806 the speed of the golf ball after the golf ball is struck by the golf club. In one embodiment, the speed of the golf ball is determined based on radar readings of the golf ball. In an alternative embodiment, the speed of the golf ball is determined based on a factor of the speed of the golf club when the golf club strikes the golf ball. The factor can be between about 1.2 and about 1.5 times the speed of the golf club. In another alternate embodiment, the speed of the golf ball is determined based on a distance the golf ball travels between the first and second images and the amount of time between the first and second images.

A first command is transmitted 808 to the first camera to capture a first image of the golf ball after being struck by the golf club. In one embodiment, the first command is based on the speed of the golf club or golf ball when the golf club strikes the golf ball. In one embodiment, the first camera captures the first image when the golf ball is centrally located within the field of view of the first camera. A second command is transmitted 810 to a second camera to capture a second image of the golf ball. In one embodiment, the second command is based on the speed of the golf ball after the golf club strikes the golf ball. Additionally, or alternatively, the second command is transmitted to the second camera an amount of time after the first camera captures the first image, where the amount of time is based on the speed of the golf ball. For example, if the golf ball has a detected speed of 50 m/s, the corresponding amount of time would be about 1 millisecond. In another embodiment the second camera captures the second image when the golf ball is centrally located within the field of view of the second camera. In yet another embodiment, the second camera captures the second image when the golf ball travels for an amount of time after the first camera captures the first image. The amount of time may be, for example, between about 1 millisecond and about 10 milliseconds.

The process continues with receiving 812 the first image and the second image and determining 814 the trajectory of the golf ball based on the first image, the second image, the flight characteristics of the golf club, and/or the speed of the golf ball. In one embodiment, the launch angle of the golf ball is determined based on the first image and the second image. For example, the distance the golf ball has traveled ($\Delta x$, $\Delta y$) over the first image and the second image can be used to determine the launch angle of the golf ball. Accordingly, the trajectory of the golf ball is further based on the launch angle of the golf ball.

In another embodiment, the spin rate of the golf ball is determined based on the first image and the second image. For example, the difference in the orientation of the golf ball between the first image and the second image can be used to determine the spin rate of the golf ball. Accordingly, the trajectory of the golf ball is further based on the spin rate of the golf ball. In yet another embodiment, the lateral distance traveled by the golf ball is determined based on the first image and the second image. For example, the lateral movement of the golf ball may be determined based on the area of the golf ball and/or the pixel change in the golf ball. Accordingly, the trajectory of the golf ball is further based on the lateral distance. The process further includes presenting 816 the trajectory of the golf ball to an interface or display as part of a golf simulation or golf-related game.

Figure 9:
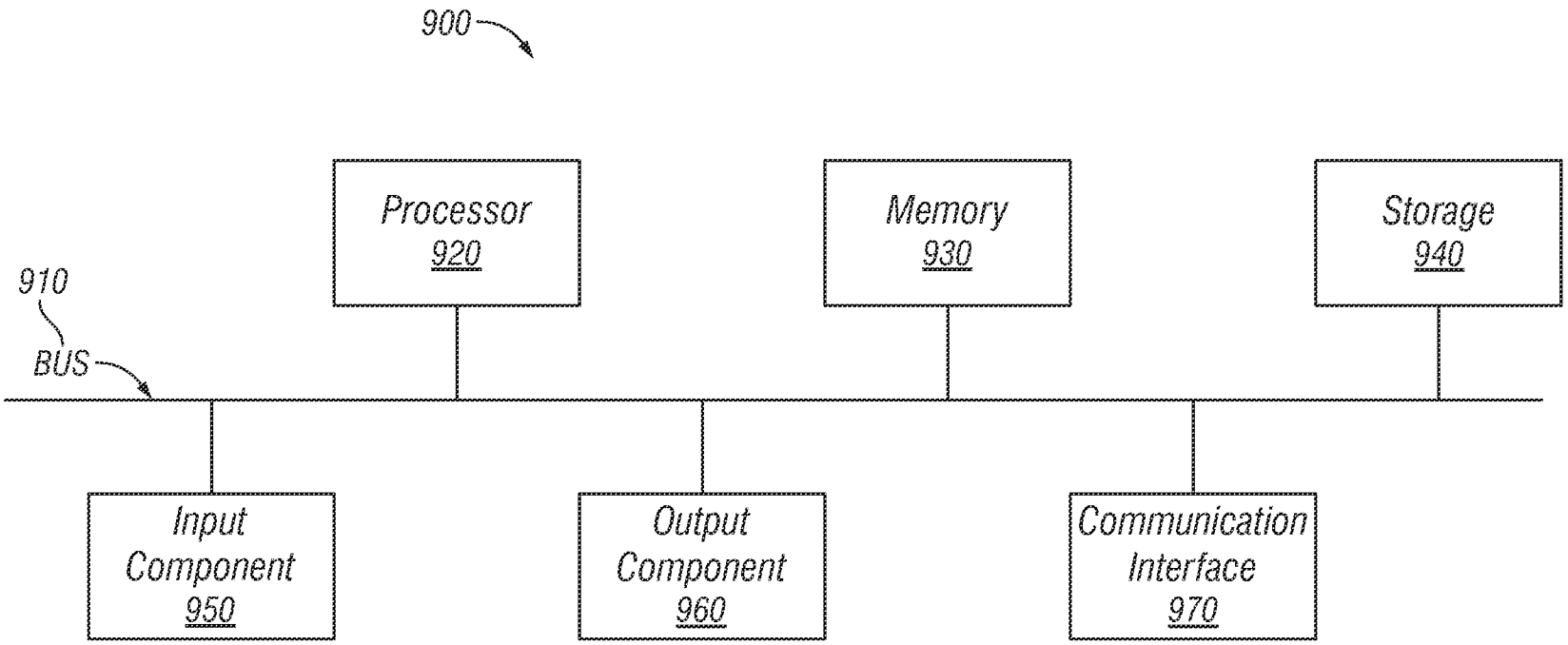
FIG. 9 depicts a diagram of example components of one or more devices of FIG. 7.

Referring to FIG. 9, a block diagram of example components of a device 900 is shown. The device 900 may correspond to the processor 708 and/or computing resources 742. In some embodiments, the processor 708 and computing resources 742 may include one or more devices 900 and/or one or more components of the device 900. As shown in FIG. 9, the device 900 may include a bus 910, a processor 920, a memory 930, a storage component 940, an input component 950, an output component 960, and a communication interface 970.

Bus 910 includes a component that permits communication among the components of the device 900. Processor 920 is implemented in hardware, firmware, or a combination of hardware and software. The processor 920 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some embodiments, the processor 920 includes one or more processors capable of being programmed to perform a function. Memory 930 includes a random-access memory (RAM), a read only memory (ROM), and/or another type of dynamic or static storage device (e.g., a flash memory, a magnetic memory, and/or an optical memory) that stores information and/or instructions for use by processor 920.

Storage component 940 stores information and/or software related to the operation and use of device 900. For example, storage component 940 may include a hard disk (e.g., a magnetic disk, an optical disk, a magneto-optic disk, and/or a solid-state disk), a compact disc (CD), a digital versatile disc (DVD), a floppy disk, a cartridge, a magnetic tape, and/or another type of non-transitory computer-readable medium, along with a corresponding drive.

Input component 950 includes a component that permits the device 900 to receive information, such as via user input (e.g., a control bar, a touch screen display, a keyboard, a keypad, a mouse, a button, a switch, and/or a microphone). Additionally, or alternatively, input component 950 may include a sensor for sensing information (e.g., a global positioning system (GPS) component, an accelerometer, a gyroscope, and/or an actuator). Output component 960 includes a component that provides output information from device 900 (e.g., a display, a speaker, and/or one or more light-emitting diodes (LEDs)).

Communication interface 970 includes a transceiver-like component (e.g., a transceiver and/or a separate receiver and transmitter) that enables device 900 to communicate with other devices, such as via a wired connection, a wireless connection, or a combination of wired and wireless connections. Communication interface 970 may permit device 900 to receive information from another device and/or provide information to another device. For example, communication interface 970 may include an Ethernet interface, an optical interface, a coaxial interface, an infrared interface, a radio frequency (RF) interface, a universal serial bus (USB) interface, a Wi-Fi interface, a cellular network interface, or the like.

Device 900 may perform one or more processes described herein. Device 900 may perform these processes based on the processor 920 executing software instructions stored by a non-transitory computer-readable medium, such as memory 930 and/or storage component 940. A computer-readable medium is defined herein as a non-transitory memory device. A memory device includes memory space within a single physical storage device or memory space spread across multiple physical storage devices.

Software instructions may be read into memory 930 and/or storage component 940 from another computer-readable medium or from another device via communication interface 970. When executed, software instructions stored in memory 930 and/or storage component 940 may cause processor 920 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 9 are provided as an example. In practice, device 900 may include additional components, fewer components, different components, or differently arranged components than those shown in FIG. 9. Additionally, or alternatively, a set of components (e.g., one or more components) of device 900 may perform one or more functions described as being performed by another set of components of device 900.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure but should not be constrained by the headings set forth herein.

Moreover, the Abstract is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus, the following claims are hereby incorporated into the Detailed Description, with each claim standing on its own as a separate embodiment.

What is claimed is:

1. A system for monitoring a trajectory of a golf ball struck by a golf club, the system comprising:

a first camera configured to capture a first image of the golf ball after the golf ball is struck by the golf club;

a second camera configured to capture a second image of the golf ball after the first image is captured;

a radar having a detection field comprising an area extending in front of, to the left of, and to the right of the golf ball, wherein the radar is configured to detect a speed of the golf club or golf ball within the detection field; and a processor in communication with the first camera, the second camera, and the radar, wherein the processor is configured to:

trigger the first camera to capture the first image of the golf ball based on the radar detecting the speed of the golf club or golf ball, trigger the second camera to capture the second image of the golf ball after the first camera captures the first image, and present the trajectory of the golf ball to an interface or a display, wherein the trajectory is based on the first image, the second image, and the flight characteristic of the golf club or golf ball.

2. The system of claim 1, wherein:

the speed of the golf club comprises the speed of the golf club at a position where the golf club strikes the golf ball;

the speed of the golf ball is based on a factor of the speed of the golf club;

the processor is configured to trigger the second camera to capture the second image an amount of time after the first camera captures the first image;

the amount of time is based on the speed of the golf ball; and the trajectory of the golf ball is further based on the speed of the golf ball.

3. The system of claim 2, wherein the factor is between about 1.2 and about 1.5 times the speed of the golf club.

4. The system of claim 1, wherein:

the first camera captures the first image when the golf ball is centrally located within a field of view of the first camera; and the second camera captures the second image when the golf ball is centrally located within a field of view of the second camera.

5. The system of claim 4, wherein:

the speed of the golf club corresponds to the speed of the golf club at a position where the golf ball is initially placed;

the processor is configured to trigger the second camera to capture the second image an amount of time after the first camera captures the first image;

the speed of the golf ball is calculated based on a distance the golf ball travels between the first and second images and the amount of time between the first and second images; and the trajectory of the golf ball is further based on the speed of the golf ball.

6. The system of claim 5, wherein:

the amount of time is between about 1 millisecond and about 10 milliseconds;

a launch angle and speed of the golf ball are based on a latitudinal distance and a longitudinal distance the golf ball travels between the first and second images; and the trajectory of the golf ball is further based on the launch angle of the golf ball.

7. The system of claim 4, wherein:

the golf ball travels a lateral distance between the first and second images;

the lateral distance is based on (i) a difference in an area of the golf ball in the first and second images and (ii) a difference in a number of pixels of the golf ball in the first and second images; and the trajectory of the golf ball is further based on the lateral distance of the golf ball.

8. The system of claim 4, wherein:

a spin rate of the golf ball is based on a first orientation of the golf ball in the first image and a second orientation of the golf ball in the second image; and the trajectory of the golf ball is further based on the spin rate of the golf ball.

9. The system of claim 1, wherein:

the first camera and the second camera have identical lenses, thereby producing identical fields of view for the first camera and the second camera;

the flight characteristic of the golf club comprises a speed of the golf club at a position where the golf club strikes the golf ball;

the processor is configured to trigger the first camera based on the speed of the golf club;

the radar is further configured to detect flight characteristics of the golf ball within the detection field, whereby the radar detects a plurality of speeds of the golf ball at a plurality of positions within the detection field after the golf ball is struck by the golf club;

the processor is configured to trigger the second camera based on the plurality of speeds of the golf ball; and the trajectory of the golf ball is further based on the plurality of speeds of the golf ball.

10. The system of claim 1, wherein:

the second camera is positioned laterally downrange from the first camera;

the radar is positioned behind the golf ball; and wherein the detection field area extends a first distance in front of the golf ball, a second distance to the left of the golf ball, and a third distance to the right of the golf ball.

11. The system of claim 10, wherein the first distance is between about one and six inches, the second distance is between about zero and about six inches, and the third distance is between about three and about six inches.

12. The system of claim 1 further comprising a control bar, wherein the control bar comprises:

a strip comprising a plurality of lights arranged along a length of the strip, wherein the lights are configured to illuminate as an indication of a position of the golf club head above the strip;

at least one proximity sensor configured to determine the position of the golf club head above the strip.

13. The system of claim 12 wherein the position of the golf club head above the strip is used as an input for controlling a golf simulation or golf video game.

14. A computing device for determining a trajectory of a golf ball struck by a golf club, the computing device comprising:

one or more memories for storing instructions; and one or more processors configured to execute the instructions to cause the one or more processors to:

receive information associated with flight characteristics of the golf club or golf ball, wherein the flight characteristics comprise radar readings of the golf club or golf ball at one or more positions in a detection field comprising an area extending in front of, to the left of, and to the right of the golf ball;

determine a speed of the golf club based on the flight characteristics of the golf club or golf ball;

determine a speed of the golf ball after being struck by the golf club;

transmit a first command to a first camera to capture a first image of the golf ball after being struck by the golf club, wherein transmitting the first command is based on the speed of the golf club or golf ball detected within the detection field;

transmit a second command to a second camera to capture a second image of the golf ball;

receive the first image and the second image;

determine the trajectory of the golf ball based on the first image, the second image, the flight characteristics of the golf club, and the speed of the golf ball; and present the trajectory of the golf ball to an interface or display.

15. The computing device of claim 14, wherein:

the flight characteristics of the golf club comprise radar readings;

the speed of the golf club is determined based on the radar readings of the golf club; and transmitting the first command is based on the speed of the golf club when the golf club strikes the golf ball.

16. The computing device of claim 15, wherein:

the one or more memories stores additional instructions that, when executed by the one or more processors, causes the one or more processors to receive information associated with flight characteristics of the golf ball;

the flight characteristics of the golf ball comprise radar readings;

the speed of the golf ball is determined based on the radar readings of the golf ball; and transmitting the second command is based on the speed of the golf ball after the golf club strikes the golf ball.

17. The computing device of claim 15, wherein:

the speed of the golf ball is determined based on a factor of the speed of the golf club when the golf club strikes the golf ball; and transmitting the second command is based on the speed of the golf ball after the golf club strikes the golf ball.

18. The computing device of claim 15, wherein:

the speed of the golf ball is determined based on the radar readings of the golf ball;

the second command is transmitted to the second camera an amount of time after the first camera captures the first image; and the amount of time is based on the speed of the golf ball.

19. The computing device of claim 14, wherein:

the one or more memories stores additional instructions that, when executed by the one or more processors, causes the one or more processors to determine a launch angle of the golf ball based on the first image and the second image; and the trajectory of the golf ball is further based on the launch angle of the golf ball.

20. The computing device of claim 19, wherein:

the one or more memories stores additional instructions that, when executed by the one or more processors, causes the one or more processors to determine a spin rate of the golf ball based on the first image and the second image; and the trajectory of the golf ball is further based on the spin rate of the golf ball.

21. The computing device of claim 19, wherein:

the one or more memories stores additional instructions that, when executed by the one or more processors, causes the one or more processors to determine a lateral distance the golf ball travels based on the first image and the second image; and the trajectory of the golf ball is further based on the lateral distance.

22. The computing device of claim 19, wherein:

the launch angle is determined based on a latitudinal distance the golf ball travels between the first and second images and a longitudinal distance the golf ball travels between the first and second images;

the spin rate is based on a first orientation of the golf ball in the first image and a second orientation of the golf ball in the second image;

the lateral distance is based on at least one of (i) a difference in an area of the golf ball in the first and second images, and (ii) a difference in a number of pixels of the golf ball in the first and second images.

23. A system for providing a virtual golf simulator or golf video game comprising:

a golf ball launch detector comprising a first camera, a second camera, and a radar; and a control bar comprising a strip comprising a plurality of lights arranged along a length of the strip, wherein the lights are configured to illuminate as an indication of a position of the golf club head above the strip and at least one proximity sensor configured to determine the position of the golf club head above the strip, wherein the system uses the position of the golf club head above the strip as an input into the virtual golf simulator or golf video game.

24. A system for providing a virtual golf simulator or golf video game comprising:

a game device comprising:

a golf ball launch detector comprising a first camera, a second camera, and a radar wherein the first camera, the second camera, and the radar generate raw launch data; and a processor that receives the raw launch data from the first camera, the second camera, and the radar to generate processed launch data;

a platform comprising computing resources that receive the raw launch data or the processed launch data from the game device via a network, wherein the raw launch data or the processed launch data is verified by a chain of trust that excludes any user device, further wherein the platform processes the raw launch data or the processed launch data to generate game data, and transmits the game data to a user device.

* * * * *